US007462142B1

(12) United States Patent
Gordon

(10) Patent No.: US 7,462,142 B1
(45) Date of Patent: Dec. 9, 2008

(54) INFLATABLE MAT HAVING INTERNAL BUNGEE CORDS

(76) Inventor: Donald W. Gordon, 1626 Crandall Dr., Springville, UT (US) 84663

( * ) Notice: Subject to any disclaimer, the term of this patent is extended or adjusted under 35 U.S.C. 154(b) by 0 days.

(21) Appl. No.: 11/894,040

(22) Filed: Aug. 16, 2007

Related U.S. Application Data

(60) Provisional application No. 60/838,330, filed on Aug. 16, 2006.

(51) Int. Cl.
*A63B 26/00* (2006.01)

(52) U.S. Cl. ..... 482/142; 482/23

(58) Field of Classification Search ..... 482/142, 482/140, 907, 23, 91
See application file for complete search history.

(56) References Cited

U.S. PATENT DOCUMENTS

2006/0191070 A1* 8/2006 Heimbrock ..... 5/81.1 R
2007/0180612 A1* 8/2007 Barth et al. ..... 5/81.1 R

* cited by examiner

*Primary Examiner*—Lori Amerson
(74) *Attorney, Agent, or Firm*—Thorpe North & Western LLP

(57) ABSTRACT

An inflatable mat for use as a training aid and supporting and rebound surface, such as for a gymnastics mat, and fall breaking landing pad, such as for a high jump and pole vaulting landing pit, includes a closed inflatable body having opposite sides and a plurality of bungee cords secured to and extending between the opposite sides whereby, when the body is inflated, a force applied to the mat, such as by an athlete jumping on the mat or falling onto the mat, will cause stretching of at least one of the bungee cords to aid in absorbing the force applied to the mat. With a closed or sealed inflatable body, the mat can be adjusted by adjusting the amount of inflation to provide shock absorption and rebound when jumping on the mat similar to a trampoline surface or to provide more deceleration and absorption of a fall onto the mat and less rebound as needed for landing pit applications.

5 Claims, 7 Drawing Sheets

INFLATABLE MAT HAVING INTERNAL BUNGEE CORDS

RELATED APPLICATION

This application claims the benefit of provisional Application Ser. No. 60/838,330, filed Aug. 16, 2006, and entitled "Inflatable Mat Having Internal Bungee Cords", hereby incorporated by reference.

BACKGROUND OF THE INVENTION

1. Field

The invention is in the field of pads or mats used as training aids, supporting surfaces, and force absorbing devices for various sport activities, particularly gymnastics, such as landing and tumbling mats, and high jumping and pole vaulting, such as landing pads in landing pits 2. State of the Art Many years ago I experimented with a combination constant flow inflatable mat with a top section comprising a wall that when the mat was fully inflated took a convex form. By connecting bungee cords horizontally between the inside of opposite side walls, making the elastic cords shorter than the normal distance between the walls when the mat was fully inflated, the walls expanded when an athlete landed on the top side of the inflated mat. The additional air pressure created by the impact of the athlete when landing on and compressing the mat caused the side walls to expand outwardly. This expansion was resisted by the elastic cords connected inside the mat. This then allowed for a smooth deceleration over a longer distance for the athlete than would be the deceleration distance provided by merely compressing the air in the mat and allowing the normal restricted escape of the air through the unsealed mat.

The bungee cords in combination with a constant flow air mat worked well for absorbing the impact of a falling body when properly designed and adjusted. A constant flow air mat is a six sided air chamber having inside baffles to maintain a desired configuration. The air chamber is not sealed, and therefore, a constant supply of air into the chamber is necessary to keep the chamber inflated. The chamber is thus filled with air by using a continually running squirrel cage type blower. This blower is generally high volume, low air pressure. It is necessary to balance the constant air flow into the air chamber with the constant loss of air from the chamber in a way that creates a pressure in the air chamber. With a particular capacity blower, a particular air pressure will be established in the air chamber. If the pressure in the chamber is to be changed with the same blower supplying air to the chamber, an opening in the chamber has to be created, enlarged, or closed, to change the air flow out of the chamber and thus balance the air flow into the chamber versus the air flow out of the chamber to create a desired pressure. Sometimes to create the deceleration desired to be provided by the mat, it was necessary to provide flaps the would release under a certain pressure created by the impact of the athlete on the mar to release air from the chamber at a controlled rate greater than the normal rate of loss of air from the chamber. This controlled air flow out of the chamber created a controlled collapse of the mat to provide a desired deceleration and cushioning by the mat. With the constant air flow mat, it is very difficult to adjust or change the air pressure in the mat and the energy absorption or energy rebound obtained with the mat. Thus, such mat and blower combination has to be designed for a particular deceleration application, such as a high jump landing pit, or for a rebound application such as a jumping mat for a particular weight range of user. An additional problem with a constant flow air mat is the requirement of having a noisy motor and blower constantly running. Further, it is necessary to have an electrical outlet available and an electrical cord running from the outlet to the blower motor.

In recent years, long constant flow air mats, fifteen to sixty feet long and six to seven feet wide, have been used as tumbling mats. These mats require a strong and generally loud blower to keep the mats firm enough to afford some rebound to the athlete tumbling onto or on the mat. Further, these constant flow mats have required a strong nylon mesh vinyl coated fabric, so there is very little natural rebound or stretch and response properties in this fabric. I have attempted to make an airtight inflatable mat that forms a sealed air chamber that can be inflated and does not require constant air flow from a blower. These mats, however, when made of a strong supported vinyl fabric, have been found too hard and unpleasant to tumble on. To try to solve this problem, I have attempted to make airtight inflatable mats using unsupported vinyl fabric which has a natural resiliency or rebound. I have made a number of products directed to gymnastic training using sealed air chambers and heavy-duty unsupported vinyl fabric. These are described in my copending patent application Ser. No. 11/156,065, hereby incorporated by reference. While these products have proven of great benefit to the gymnastics world, they have generally been best suited to the beginner and intermediate level gymnast where the gymnast applies less force to the mats than do an advanced gymnast. This is because the seams and baffle attachments in many of these mats come apart when subjected to extreme sudden applied forces, such as those applied routinely by advanced gymnasts landing on and rebounding from these mats. Further, while these mats provide good rebound for normal gymnastics maneuvers, they do not provide the larger deceleration distances needed for deceleration of a high jump or pole vault athlete or in other situation where cushioning a fall is the purpose of the pad or mat.

SUMMARY OF THE INVENTION

According to the invention, it has been found that an inflatable pad or mat can be provided that can be easily adjusted by adjusting the degree of inflation to be used as a rebound or trampoline type surface such as for a gymnastics mat or to be used as a deceleration cushioning pad such as for cushioning the fall of a high jumper or pole vaulter. A sealed inflatable body or bladder can be inflated to a desired degree of inflation, depending on the intended use, and the degree of inflation can be easily changed by the user. A key to the mat of the invention is the use of one or more elastic or "bungee" cords extending between opposite side walls of the mat inside the mat which stretch when force is applied to the mat. The applied force causes the sides of the mat to move apart in relation to one another and cause the bungee cords to stretch and to resist and slow this movement apart of the sides. It also provides rebound as the bungee cords then tend to pull the sides back toward one another.

Inflatable mats of the invention used for training surfaces and force absorbing pads, particularly for gymnastics and landing pits, such as for gymnastic shock absorbing landing mats as a gymnast lands from a vault or dismounts from the bars, and for a landing pad for high jumpers and pole-vaulters, includes an inflatable body or bladder that is inflated with air to form the mat and is sealed, such as by an air valve or plug, and includes bungee cords secured to opposite sides of the body to extend between the opposite sides. When the mats are inflated, the bungee cords are pre-stretched to a desired extent by the inflation of the mat causing a separation of the sides to which the bungee cords are attached. Then, in use, when force is applied to the mat which tends to further separate the sides to which the bungee cords are attached, the bungee cords will stretch resisting the separation of the sides to provide cushioning as the sides are separating and will then react to pull the sides together again. Depending upon the degree of stretch and the pre-stress or pre-stretch of the bungee cord, varying degrees of rebound can be provided for the mat. Generally the greater the inflation, the greater the rebound of the mat, but the less the deceleration or cushioning provided by the mat. Less inflation is needed where most shock absorption or deceleration is needed, such as when the mat forms a landing pad for high jumping or pole vaulting. The mats generally also include internal baffles to provide and maintain the desired configuration of the mat when inflated, for example to keep the top and bottom surfaces relatively flat, but such baffles are not secured to extend between the portion of the sides between which the bungee cords extend so do not interfere with the stretching of the bungee cords.

The connection of the internal baffles to the body may be reinforced to prevent separation of the baffles from the body and/or to prevent the tearing of the body material and creation of air leaks at or along the connection with the baffle. This has been found to be a problem in some instances when a gymnast lands with great force directly on the mat at the location of a connection of the baffle to the body. This reinforcement can be obtained, for example, by making the baffle in an I-beam configuration so that the flanges of the I-beam are secured to the body with the web of the I-beam forming the baffle extending between the top and bottom, between the ends, or between the side other than where the bungee cords extend. Other reinforcements can also be used, such as double layers of body material laminated or otherwise glued or welded to the body material at the location of securement of the baffles or at point of expected stress along the attachment of the baffles. The reinforcement spreads the load or stress of the attachment over a larger area of the body so that a small stress point which might occur and which might tear the body material or the baffle material is spread over a larger area or is otherwise diffused to prevent tearing of the body or of the baffle when the stress occurs. This process may also be applied to corner and edge seams and connections. These reinforcement methods may be applied also to inflatable mats and pads not having the bungee cords, such as the mats and pads shown in my cited pending patent application Ser. No. 11/156,065. The mats of the present invention with bungee cords, however, have a lesser tendency to tear and separate than mats without the bungee cords as the bungee cords absorb a lot of the sudden shock of an athlete landing on the mat.

Since, as indicated above, different deceleration or shock absorption properties and different rebound properties of the mat can be provided by different inflations of the mat, if desired, an air pressure indicator or gauge can be provided in communication with the interior of the inflated mat so a user can determine the pressure of the air inside the mat and can adjust the pressure to give desired shock absorption and rebound properties. The inflation indicator may be separate from the inflation inlet, or may be incorporated into the air valve or inflation inlet. For example, a threaded inlet stem and valve can be provided for inflation of the mat, similar to a tire stem and valve, and, after inflation, a pressure gauge can be threaded onto the stem to indicate the inflation pressure on a continuing basis. If a separate indicator is provided, the pressure can be determined during inflation so the inflation can be stopped when the desired inflation pressure is reached.

The mats can be configured to be joined with other mats to form a wide variety of desired configurations. Thus, where a thick mat is required for a landing pit, several mats can be stacked upon one another to provide the needed thick pad. Of course, a single mat can be made in any desired thickness to provide the desired deceleration without the need for stacking mats. However, where mats are provided in a standard thickness to be used in a variety of uses, desired thicknesses can be obtained by stacking standard thickness mats. Various securing means, such as straps and/or pads with hook and loop fasteners, may be provided on the mats being stacked to hold them together in desired configuration. A long mat with different characteristics for gymnastic maneuvers may be formed from several mats of the invention placed end-to-end and/or side-by-side and secured together. For example, one mat inflated to provide good rebounding properties can be connected to a mat inflated to provide good shock absorbing properties so that a gymnast can launch into a maneuver using the rebound from the first mat and land the maneuver on the shock absorbing mat.

To further enhance the absorbing characteristics of the mat when it is used for deceleration or absorbing landings, a foam top layer or contact mat can be added to the top of the mat. The foam top layer can be, for example, a two inch to four inch primary urethane foam contact mat. This foam contact mat will usually be fabric covered for better appearance and increased durability. This mat provides softer contact to the person landing on the mat, and importantly, when used for landing pits in high jumping and pole vaulting, prevents spiked track shoes from puncturing the inflated base mat. Further, one or more edges of the mat can be protected by a sheet of a protective material, such as ethafoam. This is particularly useful for the edge of the pad toward the direction of the jump or pole vault bar to protect the inflated base pad from the spiked track shoes if the jumper or vaulter misses the takeoff and runs into the side of the pad. The sides of the mat could also be protected by flaps of protective material extending down the side to be protected from the top mat.

The mats can be made of various materials, such as supported or unsupported vinyl or similar materials and combination of these materials. Supported vinyl is reinforced vinyl, i.e., fabric, such as nylon or rayon fabric coated or impregnated with vinyl. Unsupported vinyl is sheet vinyl without any fabric reinforcement. The supported vinyl is generally stronger and more tear resistant than unsupported vinyl and is less stretchable. The unsupported vinyl is generally softer and more pliable and is somewhat stretchable.

THE DRAWINGS

In the accompanying drawings, which show the best mode currently contemplated for carrying out the invention:

DETAILED DESCRIPTION OF THE ILLUSTRATED EMBODIMENTS

Figure 1:
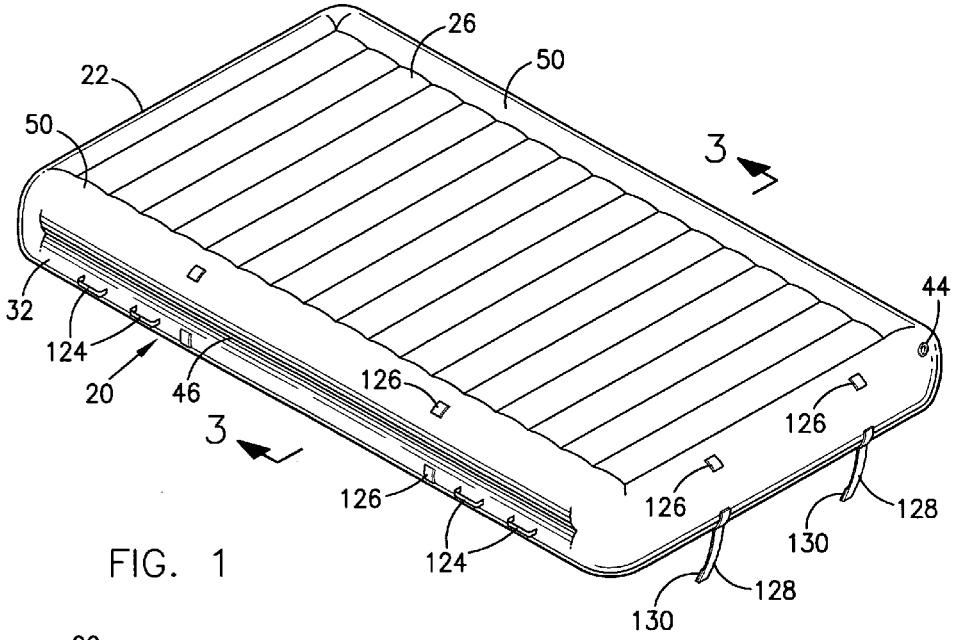
FIG. 1 is a perspective view of a mat according to the invention.

An illustrative example of a mat of the invention is shown in FIGS. 1-7. As shown in FIGS. 1-7, a mat 20 includes an inflatable body 22 formed by an air impermeable material, such as a supported or unsupported vinyl material. The body includes a plurality of baffles 24 secured to and extending between the top wall 26 and the bottom wall 28 to maintain the top 26 and bottom 28 substantially flat. A plurality of elastic or bungee cords 30 are secured to and extend between opposite side walls 32 and 34 of the inflatable body 22. The bungee cords can be attached in any suitable manner. For example, as shown, D rings 40 can be secured to the inside of the body side walls 32 and 34 at intervals along the length of the side walls and centered along the center axis of the side walls and the bungee cords 30 can include hooks 42 secured at their ends to be hooked over the D rings 40. The body 22 can be inflated to a desired pressure through valve 44.

Figure 3:
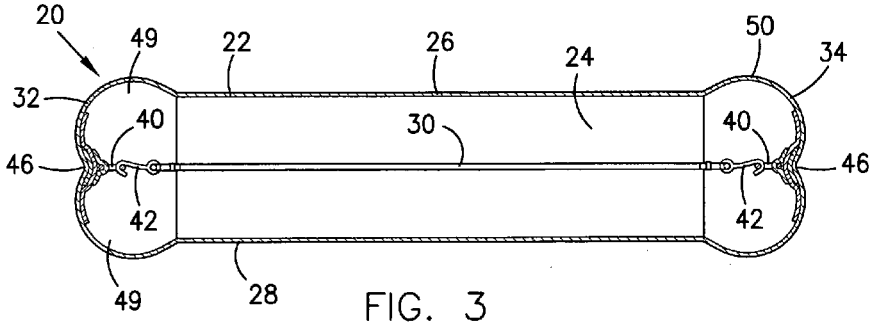
FIG. 3 is a vertical section taken on the line 3-3 of FIG. 1.
Figure 2:
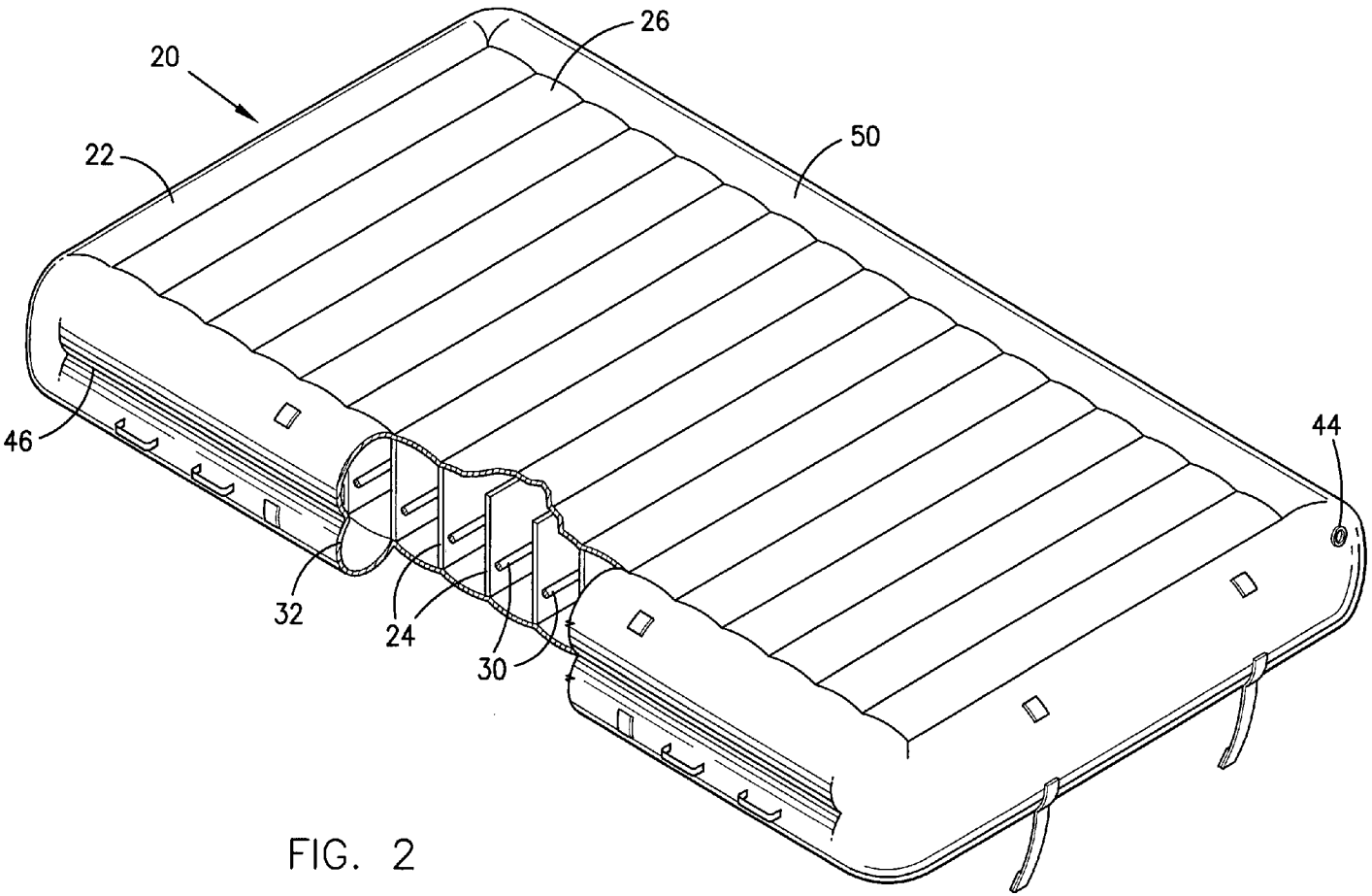
FIG. 2 is the perspective view of the mat of FIG. 1 with a portion of the outside thereof broken away to show the interior construction thereof.
Figure 5:
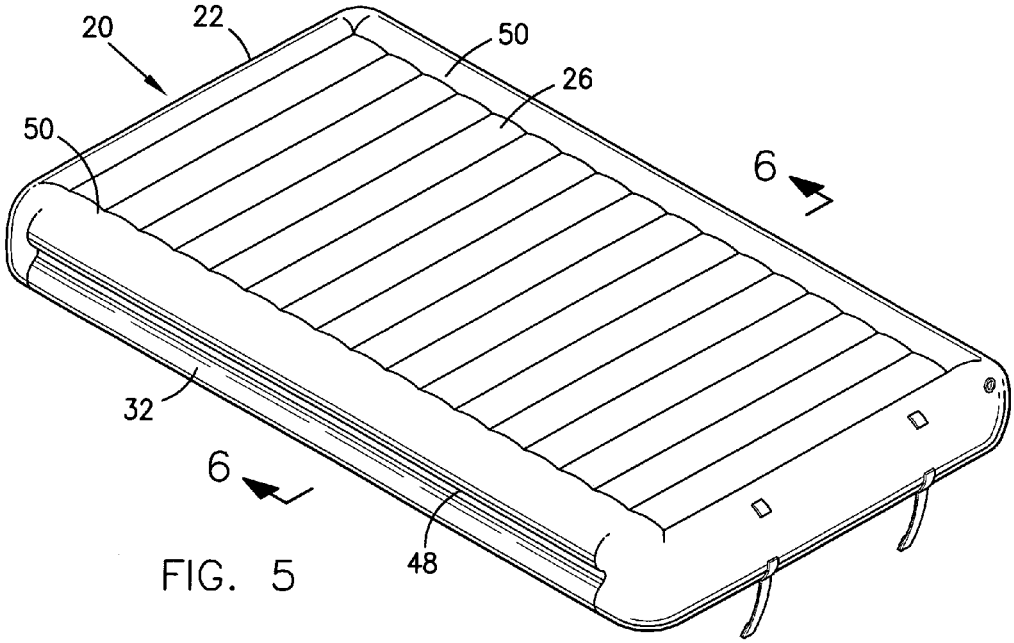
FIG. 5 is a perspective view similar to that of FIG. 1, but showing a different initial inflation of the mat.
Figure 6:
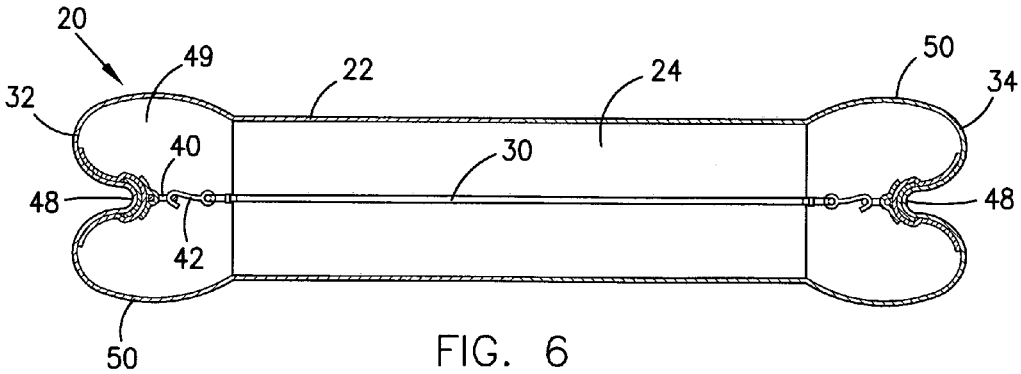
FIG. 6 is a vertical section similar to that of FIG. 3, but taken on the line 6-6 of FIG. 5.

The mat 20 is configured to have a desired width when inflated. The normal unstretched length of the bungee cords 30 is shorter than the width of the pad when inflated to the normal desired width so that the bungee cords will exert force to pull the mat side walls toward one another. This force is countered by the pressure of the inflation air in the mat. As shown in FIGS. 1-3, the mat can be inflated to a pressure which will cause the side walls to stretch the bungee cords to the extent that the side walls 32 and 34 of the mat are substantially straight, with merely a small buckle or inward crease 46 formed by the force of the bungee cords pulling the side walls 32 and 34 together. FIGS. 5 and 6 show the mat 20 inflated to a lesser degree where a larger buckle or crease 48 is formed by the bungee cords pulling the side walls 32 and 34 closer together. The baffles 24 which extend between the top and bottom walls do not extend all of the way to the side walls. They terminate before reaching the side walls to provide an open space 49 along the inside of each side wall into which the bungee cords can freely pull the side walls. This open space 49 accommodates some stretch of the bungee cords in the mat. Thus, as shown in FIG. 6, the longitudinal center axis of the side walls 32 and 34 which coincide with larger creases 48 are pulled into the pad almost to the ends of the baffles 24. It should also be noted that the inflation of the mat causes the circumference of the top and bottom walls, i.e., the open space 49 between the ends of the baffles and the side walls, to bulge to some extend as at 50. The top side will generally bulge more than the bottom side which rests on a supporting surface such as a floor or the ground because of the weight of the mat, and a bottom bulge may not even be present. This bulge serves as a safety edge for the mat to direct an athlete landing toward the edge of the mat back toward the center of the mat.

Figure 4:
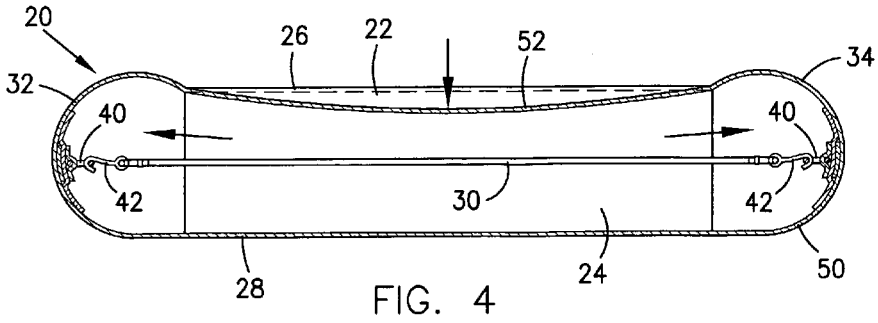
FIG. 4 is a vertical section similar to that of FIG. 3, but showing a different condition of the mat.

Referring again to FIGS. 1, 3, and 4, FIGS. 1 and 3 show the mat in an inflated rest condition. If an athlete jumps on the mat, as the athlete lands on the mat, the athlete applies a downward force on the top of the mat at the place where the athlete lands on the mat. This downward force will tend to form a depression 52, FIG. 4, in the top of the mat where the force is applied, i.e., where the athlete lands. With the mat inflated to the rest condition shown in FIG. 3, the athlete landing on the top of the mat to form the depression 52 will cause some compression of the air in the mat as well as some stretching of the mat body material, (which is all that will happen in an inflated mat without bungee cords), and importantly, will cause the sides of the mat to bulge outwardly thereby stretching the bungee cords so that the mat takes a configuration such as shown in FIG. 4. The elasticity of the bungee cords will absorb the force applied by the athlete when landing on the top of the mat and will decelerate the athlete cushioning the athlete's landing as the depression 52 is formed and the bungee cords stretch. When the force of the athlete's landing is absorbed, the bungee cords will contract pulling the sides of the mat toward one another again pushing the top wall in depression 52 upwardly thereby returning energy absorbed by the bungee cords to the athlete, in a manner similar to a trampoline, to provide rebound to the athlete. The mat with the bungee cords can store and return more energy to a jumping athlete than can an air mat without the bungee cords, as well as providing better deceleration and cushioning for the athlete when landing on the mat.

Figure 7:
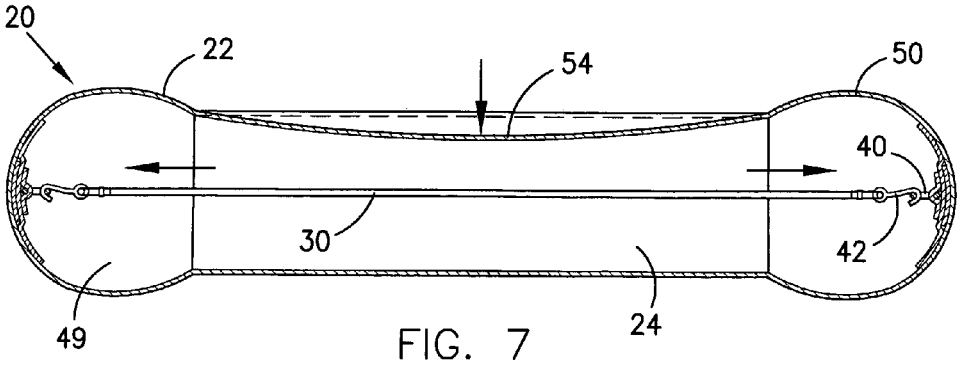
FIG. 7 is a vertical section similar to that of FIG. 4, and showing the similar situation of FIG. 4 for the inflation condition of FIG. 5.
Figure 8:
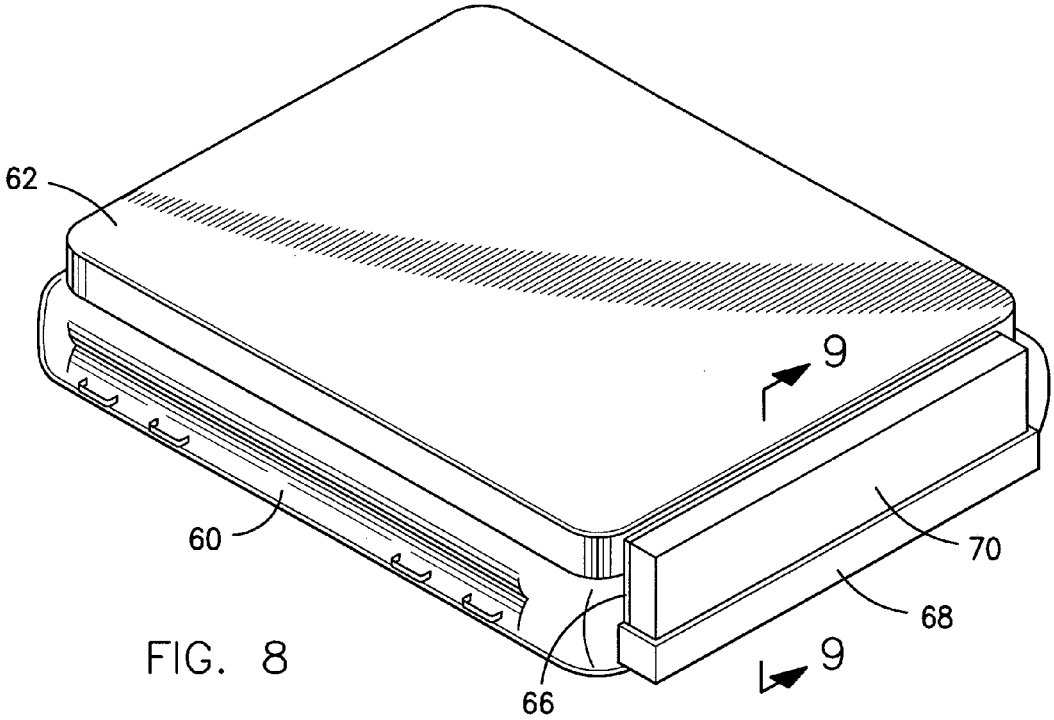
FIG. 8 is a perspective view of a mat of the invention used specifically for a landing pit.
Figure 9:
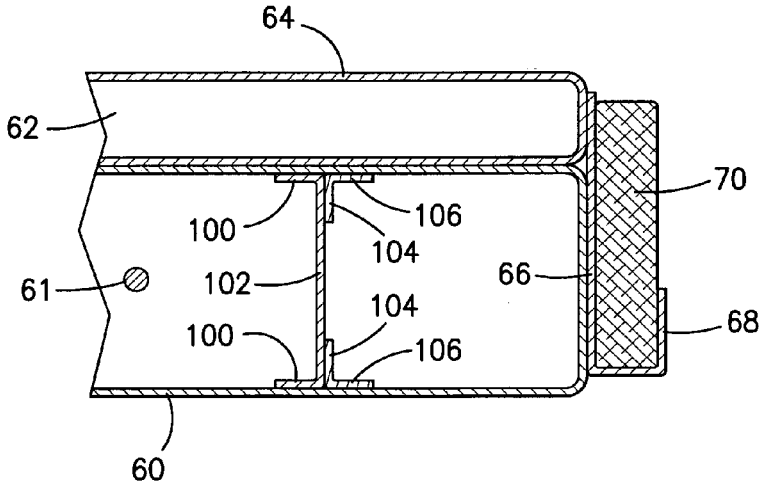
FIG. 9 is a vertical section taken on the line 9-9 of FIG. 8.

The amount of deceleration and cushioning and the amount of rebound provided by the mat depends upon the rest inflation condition of the mat, the pressure of the inflating air at the rest condition, and the strength of the bungee cords, which is affected by the number of bungee cords used and the degree of stretch of the bungee cords at the rest condition. Referring to FIGS. 5-7, with the bungee cords in FIGS. 5 and 6 not stretched as far in rest condition as in FIGS. 1 and 3, the mat is in a condition to provide a greater deceleration distance, resulting in more cushioning for an athlete landing on the mat. Thus, assuming that the mats of FIGS. 5-7 are the same as the mats of FIGS. 1-4 in terms of the strength and number of bungee cords, the difference merely being in the rest condition air pressure in the mat, i.e., the amount of inflation provided by the user to the mat, the inflation setting as shown in FIGS. 5-7 would be used where more cushioning is desired, for example for landing from a fall or dismount, rather than where more rebound is desired, for example for jumping. In the case of FIGS. 5-7, an athlete landing on the mat in the rest condition of FIGS. 5 and 6 would cause a greater depression 54 as shown in FIG. 7 to stretch the bungee cords the same amount as they were stretched in FIG. 4, while providing a longer and slower deceleration to get to the condition of bungee stretch of FIGS. 4 and 7 (larger depression 54 as opposed to small depression 52). Generally, with the right combination of baffles and bungee cords, and the right thickness, elasticity, and number of the bungee cords, a sealed inflated mat can be used both as a tumbling and rebound surface and as a deceleration (stop the fall) mat by merely adjusting the inflation of the mat, which can easily be done by a user. Further, the right thickness of the mat is necessary as a tumbling and rebound mat generally can be thinner than a fall stopping mat which is to provide a greater deceleration distance (deeper mat depression).

Where a mat is going to be used primarily as a deceleration pad as in the landing pit of a high jump or pole vault, the mat will preferably include a top pad of a cushioning foam material, such as a two to four inch thick urethane pad. This foam pad is important to protect the inflatable mat from puncture by the athlete's spiked track shoes used during the high jump and pole vaulting track events, and also adds to the cushioning provided by the mat. For track uses, it is also advantageous to provide protection along the front side of the mat toward the jump so that if a jumper of vaulter misses the jump or vault and runs into the pad, the pad is protected from the spike shoes. FIGS. 8 and 9 show an inflatable pad 60 with internal bungee cords 61 used specifically for a high jump and pole vault landing pad. The pad is shaped to correspond to the shape of the landing pit, and includes a foam pad 62 positioned on top of the inflated landing pad 60. The foam pad 62 can be covered with a covering material 64, such as a vinyl material, with the cover having a flap 66 extending down therefrom to cover the front of the inflatable pad 60 and providing a pocket 68 therein to receive a protective material such as a sheet 70 of ethafoam. Thus, if a jump is missed and the jumper runs onto the landing pad, the inflatable portion of the pad will be protected. The foam pad 62 can be secured to the top of the inflatable pad 60 in various ways such as with straps or other connectors. Alternately, the cover 64 for foam pad 62 may have flaps similar to flap 66, with or without pocket 68, which will position and hold the foam pad 62 on inflatable pad 60.

Figure 10:
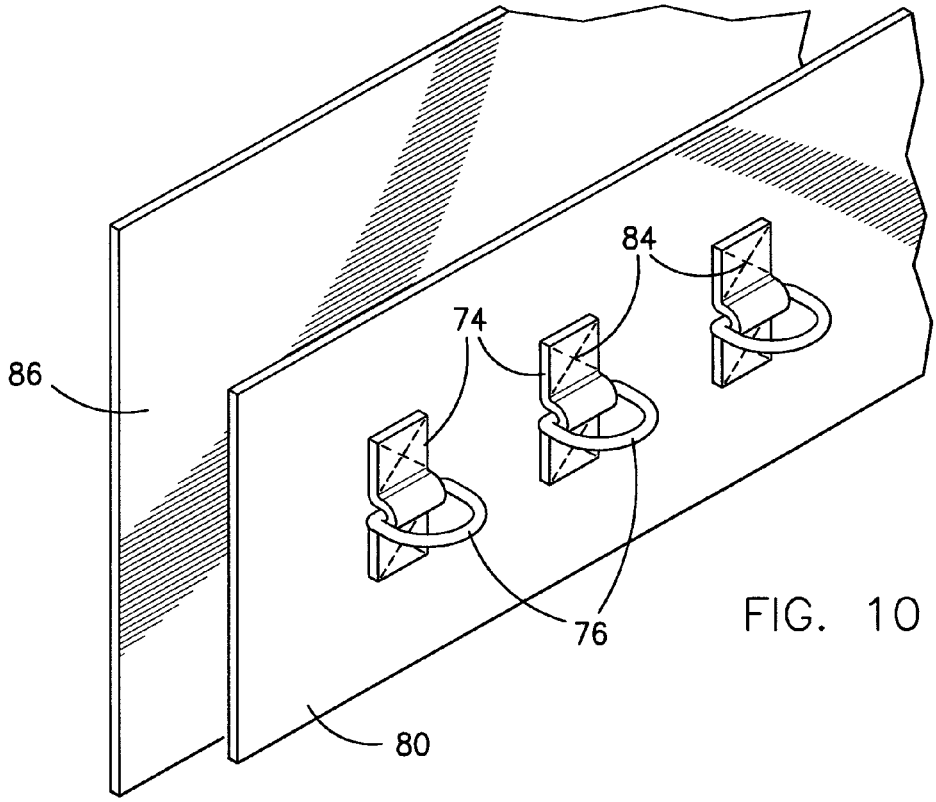
FIG. 10 is a front elevation of a piece of material with D rings mounted thereto.
Figure 11:
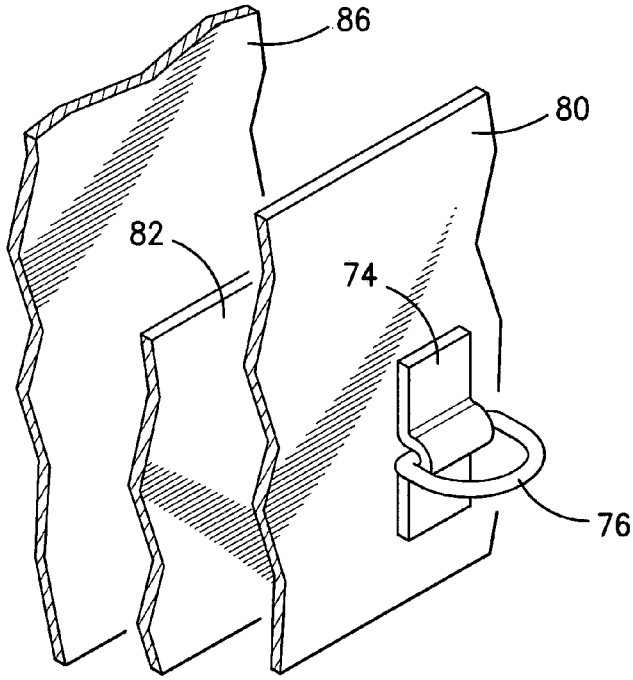
FIG. 11 is an assembly view of one of the D ring mountings of FIG. 10.
Figure 12:
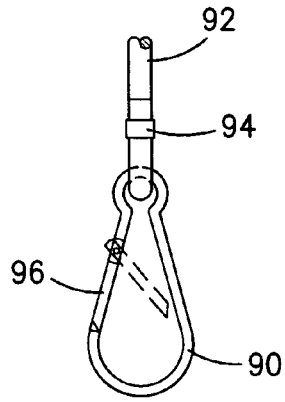
FIG. 12 is a side view of the end of a bungee cord with snap link attached thereto.

A consideration in construction of the mats or pads of the invention is the durability of the mats or pads. Thus, care should be taken in the attachment of the bungee cords to the inside of the mat to attach the cords in a manner to reduce the chance of a bungee cord becoming detached or to reduce the chance that pressure from the attachment will tear the mat material to which it is secured. Various ways of securing the bungee cords to the side walls of the mat can be used, such as by using D rings or other rings or hooks secured to the side walls to mate with and hold rings or hooks secured to the ends of the bungee cords or other elastic cords. For example, as shown in FIGS. 10 and 11, a piece of webbing material 74 can be passed through D ring 76 and can be secured, such as by gluing, to material 80. A similar piece of webbing material 82 can be secured to the back side of material 80 and the two pieces can be stitched together by stitching 84 passing through webbing 74, material 80, and webbing material 82. The material 80 can be a strip of material similar to that from which the pad is made having a length to extend the length of the side wall of the mat where bungee connections are to be made and which, after attachment of the D rings is glued or otherwise attached to the inside of the mat wall, shown as 86, or the material 80 can be the mat side wall itself so that the D rings 76 are secured directly to the side walls. When material 80 is the mat side wall, care has to be taken to ensure that the attachment of the pieces of webbing material and the stitching material which extends through the side wall is sealed to prevent air leakage through the stitching. This is not a problem when material 80 is a separate piece of material glued to the side wall as no stitching passes through the side wall. Various other attachment methods for attaching the D rings to the mat can be used. The ends of the bungee cords can have various types of hooks connected in various manners, and preferably the hooks are closed so that once attached during manufacture of the mats, will not become disconnected from the D rings. As an example, a spring link or snap link 90 as shown in FIG. 12, attached to bungee 92 by crimp ring 94, can be used. Hinged spring link 96 will open to allow the link to attach to the D ring, but otherwise remains closed to maintain the securement. Various other attachment methods for attaching the bungee cords to the D rings can be use. Further, various other attachment methods for attaching the bungee cords to the sides of the mat can be used.

Similarly, the attachment of the baffles to the top and bottom sides of the mat can be done in various ways to spread the load and prevent pressure points that can result in tears of the mat material. As an example, as shown in FIG. 9, this reinforcement can be obtained by making the baffle in an I-beam configuration so that the flanges 100 of the baffle 102 are secured to the top and bottom walls of the mat and a reinforcing angle piece of similar material has one side 104 secured to the baffle and the other side 106 secured to the mat. This provides the I-beam configuration to the baffle and the I-beam attachment to the mat. Other reinforcements can also be used, such as double layers of body material laminated or otherwise glued or welded to the body material at the location of securement of the baffles or at point of expected stress along the attachment of the baffles. In the case of both the bungee attachment and the baffle attachment, the reinforcement spreads the load or stress of the attachment over a larger area of the mat body so that a small stress point which might occur and which might tear the body material or the baffle material is spread over a larger area or is otherwise diffused to prevent tearing of the body or of the baffle when the stress occurs. This process may also be applied to corner and edge seams and connections.

Figure 13:
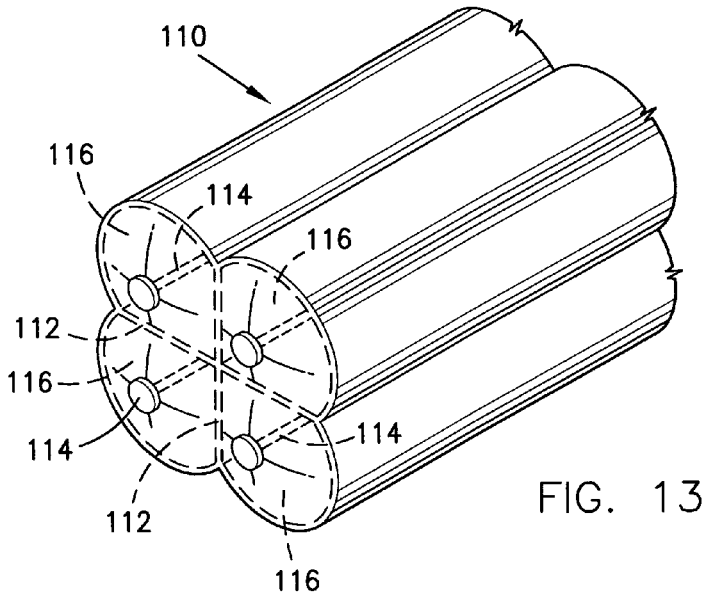
FIG. 13 is a perspective view of a component part of a further embodiment of the invention.
Figure 14:
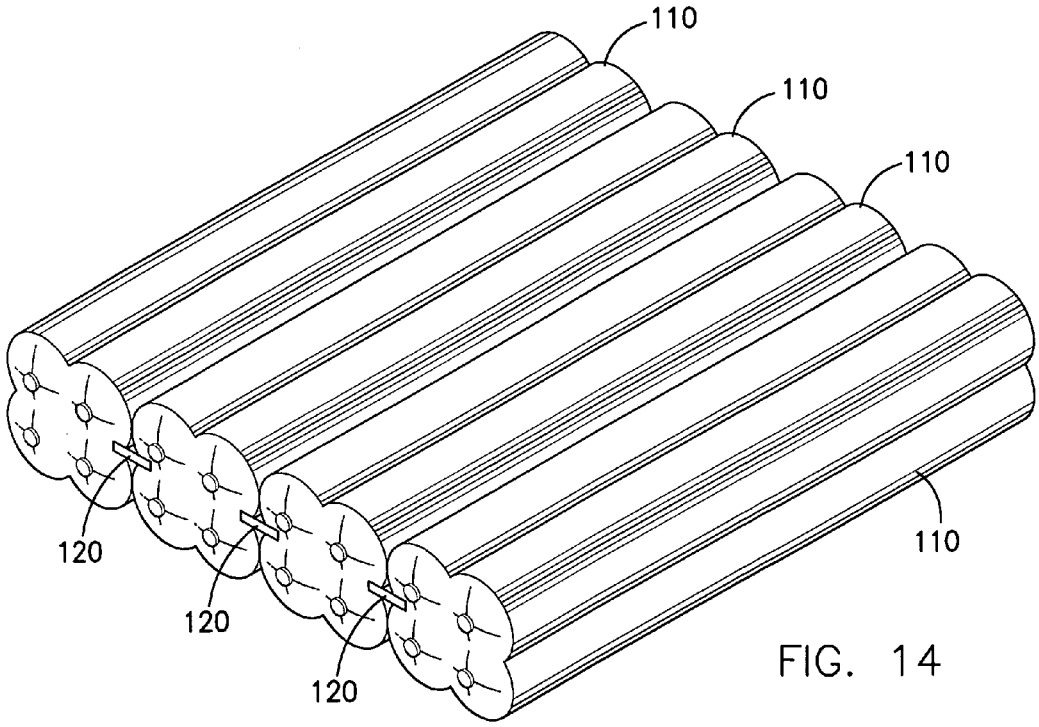
FIG. 14 is a perspective view of a mat made from four of the component parts shown in FIG. 13.

In a further embodiment of the mat of the invention, the mat can be made up of a plurality of elongate tubular components. As shown in FIG. 13, each component 110 has an inflatable elongate tubular body with an X shaped baffle 112 therein and four bungee cords 114, one in each of the four chambers 116 formed by the baffles 112, secured to and extending between the components ends. The mat components are inflated to a desired pressure to stretch the bungee cords to the desired degree and provide a desired air pressure in the component depending upon the intended use of the mat made from the components. Various shaped mat configurations can be formed by attaching a plurality of the basic tubular components together. FIG. 14 shows an elongate mat 118 formed by connecting four of the tubular components 110 together side-by-side. Connectors 120, such as of hook and loop fastener construction, or straps with buckles, can be used to secure the components together. Alternately, an outer cover can be provided which holds the components together in the desired shape.

The mats of the invention can be made in any desired size depending upon the use. Further, mats can be secured together to form various mat configurations. For example, for tumbling mats, mats can be six to seven feet wide, twelve or more inches thick, and fifteen to sixty feet long. In an example mat as shown in FIGS. 1-7 having a top and bottom width of seven feet, the bungee cords can have a prestretched length of between five and seven feet, and can stretch under applied forces with the bulging of the sides to about seven and one half feet.

The mats of the invention can have various handles secured to them in various manners, locations, and orientations, to facilitate movement and positioning of the mats. Further, the mats can have various connectors positioned to facilitate attachment or stacking of the various mats into various desired configuration. For example, as shown in FIG. 1, handles 124 can be provided at various convenient locations on the mat to allow the mat to be moved as desired. Also, straps or patches of loop or hook material 126 can be provided secured to the mats at various convenient locations on the mat to mate with straps of hook or loop material from another mat, or separate straps of mating hook or loop material to extend between the loop or hook pads secured to the mats. For example, patches 126 can be of loop material to mate with hook material 130 on a strap 128 from, for example, a mat stacked on top of the mat of FIG. 1 to hold the mats in stacked configuration. Alternately, if the mats are stacked, a separate strap of hook material could extend to attachment to pads 126 of loop material on the stacked pads to hold them in stacked or other desired configuration.

The mats can be made of various materials, such as supported or unsupported vinyl or similar materials and combination of these materials. Supported vinyl is reinforced vinyl, i.e., fabric, such as nylon or rayon fabric coated or impregnated with vinyl. Unsupported vinyl is sheet vinyl without any fabric reinforcement. The supported vinyl is generally stronger and more tear resistant than unsupported vinyl and is less stretchable. The unsupported vinyl is generally softer and more pliable and is somewhat stretchable. While reference is made herein to "bungee cords", it should be understood that such reference comprehends not only traditional bungee cords which are lengths of elastic material with hooks at the ends thereof, but any elastic or other stretchable material which can be stretched with stretching pressure applied thereto and which will resist such stretching and will return to a reduced stretched or unstretched condition upon a reduction of stretching pressure applied thereto. While the bungee cords have been described as secured to and extending between opposite sides of the mat, and the drawings show the bungee cords attached to and extending between longitudinal sides of the mat, it should be understood that the "opposite sides" of the mat to which the bungee cords are secured and extend between can be any sides of the mat which include ends, top and bottom sides, or internal walls in the mat such as baffles, depending upon the intended use of the mat. Therefore, bungee cords secured to and extending between internal baffles or between an internal baffle and a longitudinal side, an end, or the top or bottom of the mat are considered as extending between opposite sides of the mat.

Figure 15:
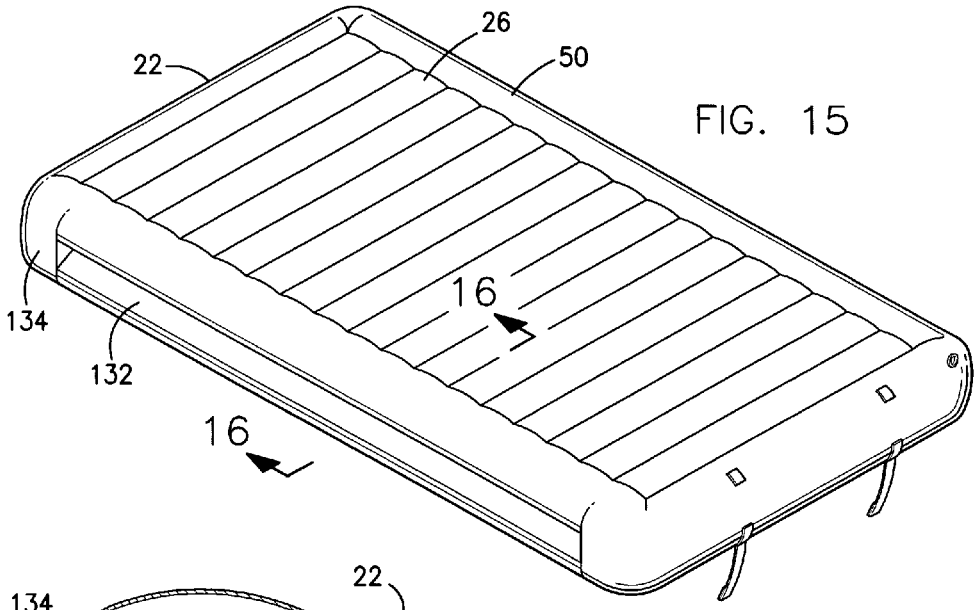
FIG. 15 is a perspective view similar to FIG. 1, but showing a further embodiment of the invention.
Figure 16:
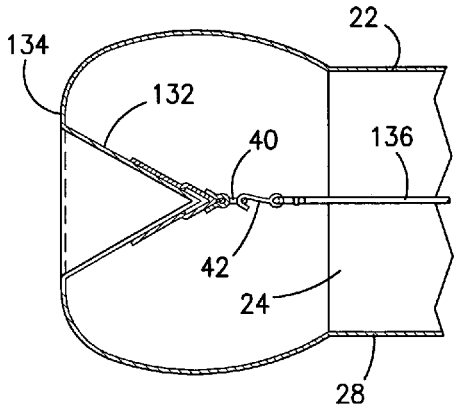
FIG. 16 is a fragmentary vertical section taken on the line 16-16 of FIG. 15.
Figure 17:
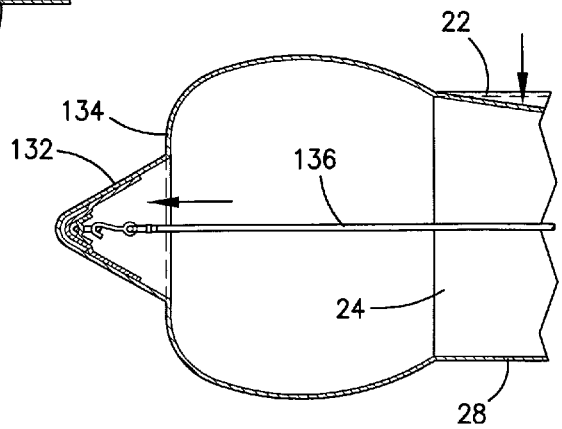
FIG. 17 is a fragmentary vertical section similar to that of FIG. 16, but showing a different condition of the mat.

If desired and necessary to provide the desired characteristics of the mat in terms of stretching of the bungee cords to provide the desired deceleration or cushioning or rebound for the mat, additional areas or pockets of material 132, FIGS. 15, 16, and 17, can be provided, usually in the side walls 134, to form extensions of the side walls 134 to which the bungee cords 136 are attached to provide more stretching movement to the bungee cords for a given compression of the mat than would otherwise be the case with just the expansion of the side walls in response to the same compression. As shown by a comparison of FIGS. 16 and 17, the pocket of material provides substantially more stretching of bungee cords 134, than merely the movement of the entire side walls would do for a given compression. The pockets can extend the length of the side walls or can be shorter to exaggerate the movement.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

I claim:

1. A method of increasing the shock absorption and rebound of an inflatable mat, comprising:

providing a plurality of bungee cords internally of the inflatable mat secured to and extending between opposite sides of the mat in a manner so that when the body is inflated, a force applied to the mat will cause stretching of at least one of the bungee cords to aid in absorbing the force applied to the mat.

2. A method of increasing the shock absorption and rebound of an inflatable mat according to claim 1, including the additional step of providing internal baffles in the mat to provide a desired shape to the mat when inflated.

3. A method of increasing the shock absorption and rebound of an inflatable mat according to claim 2, wherein the mat has top and bottom sides and the step of providing internal baffles provides baffled secured to and extending between the top and bottom sides of the mat to maintain substantially flat top and bottom surfaces of the mat when inflated.

4. A method of increasing the shock absorption and rebound of an inflatable mat according to claim 3, wherein the mat is elongate with longitudinal sides, and the step of providing a plurality of bungee cords internally of the inflatable mat secured to and extending between opposite sides of the mat is securing the bungee cords to extend between longitudinal sides.

5. A method of increasing the shock absorption and rebound of an inflatable mat according to claim 1, wherein the mat is elongate with longitudinal sides, and the step of providing a plurality of bungee cords internally of the inflatable mat secured to and extending between opposite sides of the mat is securing the bungee cords to extend between longitudinal sides.

* * * * *